US010093454B1

(12) United States Patent
Kalyan et al.

(10) Patent No.: US 10,093,454 B1
(45) Date of Patent: Oct. 9, 2018

(54) UNMANNED AERIAL VEHICLE PAYLOAD RECEIVING APPARATUS

(71) Applicant: Amazon Technologies, Inc., Seattle, WA (US)

(72) Inventors: Atishkumar Kalyan, Seattle, WA (US); Lauren Marie Kisser, Seattle, WA (US); Sheridan Leigh Martin, Des Moines, WA (US)

(73) Assignee: Amazon Technologies, Inc., Seattle, WA (US)

( * ) Notice: Subject to any disclaimer, the term of this patent is extended or adjusted under 35 U.S.C. 154(b) by 42 days.

(21) Appl. No.: 14/701,457

(22) Filed: Apr. 30, 2015

(51) Int. Cl.

| | |
|---|---|
| ***A47G 29/12*** | (2006.01) |
| ***B65D 33/14*** | (2006.01) |
| ***B65D 30/00*** | (2006.01) |
| ***B65D 33/00*** | (2006.01) |
| ***B65D 21/08*** | (2006.01) |

(52) U.S. Cl.
CPC ..... *B65D 33/14* (2013.01); *B65D 21/086* (2013.01); *B65D 29/00* (2013.01); *B65D 33/004* (2013.01)

(58) Field of Classification Search
CPC ..... A47G 2029/144; A63B 63/083; B65B 67/12; D06F 95/004; D06F 95/002; A01D 46/22
USPC ..... 232/29; 220/9.2
See application file for complete search history.

(56) References Cited

U.S. PATENT DOCUMENTS 978,429 A * 12/1910 Barnett ..... B65F 1/12 232/43.1
3,814,359 A * 6/1974 Powell ..... B65B 67/12 248/215
4,776,512 A * 10/1988 Moore, Sr. ..... A47G 29/12 232/19
5,098,108 A * 3/1992 McKinney ..... A63B 21/1645 211/119.004

(Continued)

OTHER PUBLICATIONS

Lavars, Nick, Drone Delivery Nets Could Be the Mailboxes of the Future, http://www.gizmag.com/drone-delivery-nets-skynet/34809/, Nov. 17, 2014.

*Primary Examiner* — Shawn M Braden
(74) *Attorney, Agent, or Firm* — Athorus, PLLC

(57) ABSTRACT

Described is an unmanned aerial vehicle ("UAV") payload receiving apparatus that may be secured to a side of a structure, such as a human residence, and positioned such that a UAV can deliver a payload into the UAV payload receiving apparatus without the UAV having to land or navigate into an area that includes objects that could be harmed by the UAV and/or harm the UAV. The UAV payload receiving apparatus may include a plurality of securing members for securing the UAV payload receiving apparatus to the structure. A top frame is coupled to the securing members, positioned in a substantially horizontal direction when the UAV payload receiving apparatus is secured to a structure, and forms an opening of a size sufficient for a payload to pass through when the payload is released by a UAV positioned above the UAV payload receiving apparatus. The UAV payload receiving apparatus also includes a (Continued)

payload retainer, such as a net or bag, that is coupled to and extends in a downward direction from the top frame. The payload retainer receives and retains a payload that is placed in the UAV payload receiving apparatus.

20 Claims, 6 Drawing Sheets

(56) References Cited

U.S. PATENT DOCUMENTS 5,356,001 A * 10/1994 Luna ..... A63B 63/083
206/315.1
5,492,272 A * 2/1996 Fewer ..... A47G 29/12
232/19

* cited by examiner

UNMANNED AERIAL VEHICLE PAYLOAD RECEIVING APPARATUS

BACKGROUND

Many companies package items and/or groups of items together for a variety of purposes, such as e-commerce and mail-order companies that package items (e.g., books, CDs, apparel, food, etc.) to be shipped to fulfill orders from users. Retailers, wholesalers, and other product distributors (which may collectively be referred to as distributors) typically maintain an inventory of various items that may be ordered by users. A ground-based building, such as a materials handling facility, may maintain, process and ship such inventory.

Typically ordered items are packed in shipping packages (e.g., corrugated boxes) and shipped to the user's residence or place of business. Physical delivery of items to user specified locations has improved dramatically over the years, with some retailers offering next day delivery of ordered items. The final or last mile delivery of physical items to a user specified location is traditionally accomplished using a human controlled truck, bicycle, cart, etc. For example, a user may order an item for delivery to their home. The item may be picked from a ground-based materials handling facility, packed and shipped to the user for final delivery by a shipping carrier. The shipping carrier will load the item onto a truck that is driven by a human to the final delivery location and the human driver, or another human companion with the driver, will retrieve the item from the truck and complete the delivery to the destination. For example, the human may hand the item to a recipient, place the item on the user's porch, store the item in a post office box, etc.

While implementations are described herein by way of example, those skilled in the art will recognize that the implementations are not limited to the examples or drawings described. It should be understood that the drawings and detailed description thereto are not intended to limit implementations to the particular form disclosed but, on the contrary, the intention is to cover all modifications, equivalents and alternatives falling within the spirit and scope as defined by the appended claims. As used throughout this application, the word "may" is used in a permissive sense (i.e., meaning having the potential to), rather than the mandatory sense (i.e., meaning must). Similarly, the words "include," "including," and "includes" mean including, but not limited to. Additionally, as used herein, the term "coupled" may refer to two or more components connected together, whether that connection is permanent (e.g., welded) or temporary (e.g., bolted), direct or indirect (i.e., through an intermediary), mechanical, chemical, optical, or electrical.

DETAILED DESCRIPTION

Described is an unmanned aerial vehicle ("UAV") payload receiving apparatus that may be secured to a side of a structure, such as a human residence, and positioned so that a UAV can deliver a payload into the UAV payload receiving apparatus without the UAV having to land or navigate into an area that includes objects that could be harmed by the UAV and/or harm the UAV. For example, as discussed further below, the UAV payload receiving apparatus can be secured to an upper portion of the structure, such as the edge of the roof, gutter, etc., so that it is at a height that is above occupants of the structure and/or other objects that may be damaged by the UAV and/or damage the UAV.

The UAV payload receiving apparatus may include a plurality of securing members for securing the UAV payload receiving apparatus to the structure. A top frame is coupled to the securing members, positioned in a substantially horizontal direction when the UAV payload receiving apparatus is secured to a structure, and forms an opening of a size sufficient for a payload to pass through when the payload is released by a UAV positioned above the UAV payload receiving apparatus. The UAV payload receiving apparatus also includes a payload retainer, such as a net or bag, that is coupled to and extends in a downward direction from the top frame. The payload retainer receives and retains a payload that is placed in the UAV payload receiving apparatus.

When a UAV arrives at the structure with an item to be delivered (generally referred to herein as a payload), the UAV positions the payload over the opening of the UAV payload receiving apparatus and releases the payload into the UAV payload receiving apparatus, thereby completing delivery of the item. The released payload is retained by the UAV receiving apparatus and the user that ordered the item can later retrieve the item from the UAV payload receiving apparatus.

Figure 1:
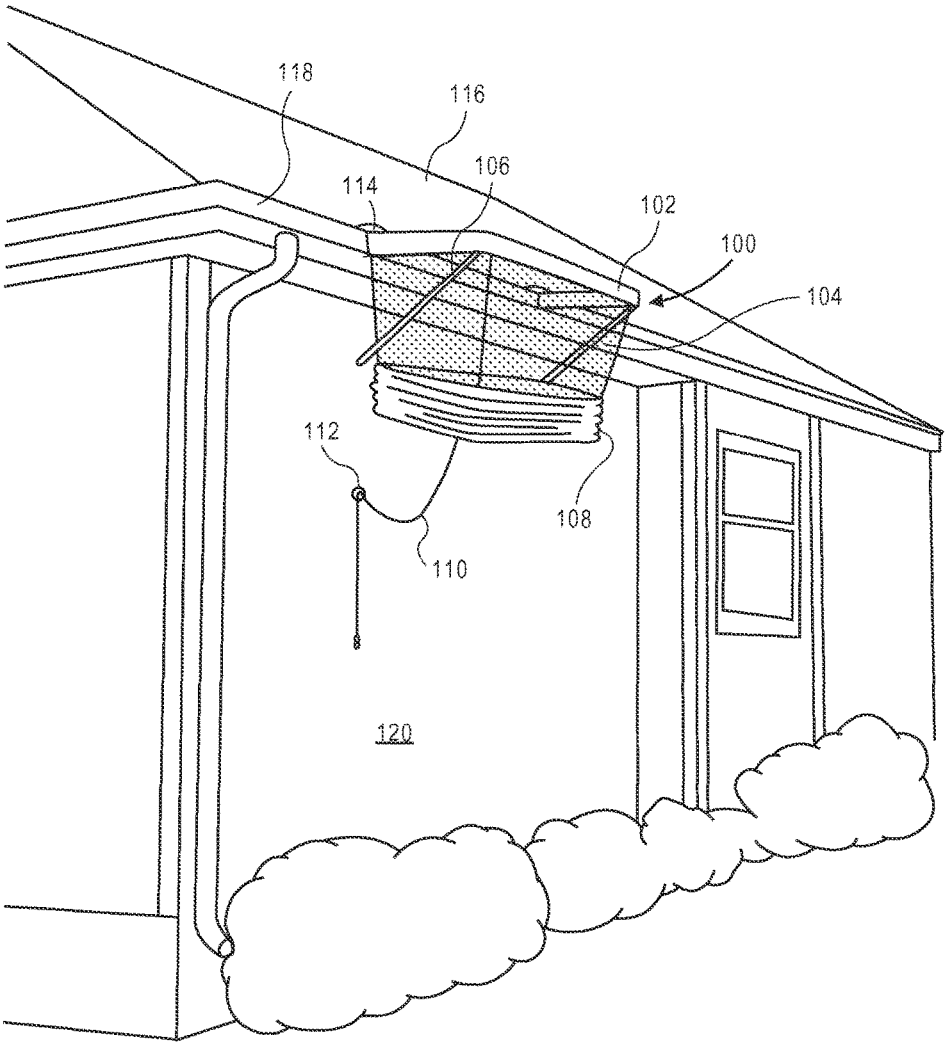
FIG. 1 is a view of an unmanned aerial vehicle payload receiving apparatus secured to a structure and in a contracted position, according to an implementation.

FIG. 1 is a view of UAV payload receiving apparatus 100 secured to a structure 116 and in a contracted position, according to an implementation. The structure 116 may be any physical object of a size sufficient to which the UAV payload receiving apparatus 100 may be secured. For example, the structure may be a human residence, a building, a warehouse, a locker, a shed, etc.

The UAV payload receiving apparatus 100 includes a plurality of securing members 114 that removably secure the UAV payload receiving apparatus 100 to the structure 116. The securing members 114 may be any mechanism for securing the UAV payload receiving apparatus 100 to the structure. For example, the securing members 114 may be any one or combination of hooks, latches, clamps, screws, adhesive, etc. In the illustrated example, the securing members 114 are hooks that secure the UAV payload receiving apparatus 100 to a gutter 118 of the structure.

Coupled to the securing members 114 is a top frame 102. When UAV payload receiving apparatus 100 is secured to a structure 116, the top frame extends from the structure in a substantially horizontal direction and provides an opening through which a payload released by a UAV positioned above the UAV payload receiving apparatus 100 may pass. The top frame may be any shape and/or size. In the implementation illustrated in FIG. 1, the top frame forms a substantially rectangular shape and includes a first short side, a second short side, a first long side, and a second long side. The first long side, the second long side, the first sort side, and the second short side form an opening of a size large enough for a payload released by a UAV positioned above the UAV payload receiving apparatus 100 to pass.

In one implementation, the average size of a payload may be approximately five inches, by approximately five inches, by approximately ten inches. To facilitate passage of the average size payload through the top frame, the top frame may have an opening of approximately fifteen inches by approximately thirty inches, or approximately three times the size of the average payload. In other implementations, the top frame may have other dimensions and/or shapes. For example, the top frame may be circular, square, rectangular, etc.

In some implementations, the top frame 102 may also include a displaceable cover (not shown). The displaceable cover may be hinged or otherwise moveably mounted to the top frame 102 so that in a default state the displaceable cover is positioned over the opening formed by the top frame 102. When a payload is released by a UAV and passes through the opening formed by the top frame 102, the weight of the payload may temporarily displace the displaceable cover when the payload contacts the displaceable cover such that the payload passes through the opening formed by the top frame 102. After the payload has passed through the opening formed by the top frame 102, the displaceable cover returns to the default state and covers the opening formed by the top frame 102.

In other implementations, the displaceable cover (not shown) may be mechanically operated and provide security to a payload that is positioned within the payload receiving apparatus 100. For example, the displaceable cover may include a security component that prohibits access to the payload retainer 104 through the opening formed by the top frame 102. In such a configuration, the displaceable cover may include a receiver that is configured to receive a wireless transmission from a UAV that is delivering a payload. The wireless transmission may include a code or other identifier that is received by the displaceable cover. In response to receiving the code or other identifier, the displaceable cover allows access to the payload receiving apparatus 100 so that the payload can be delivered into the payload receiving apparatus 100 by the UAV. Once the payload is released and passes into the payload receiving apparatus 100, the displaceable cover may move back to the default position and prohibit access to the payload retainer.

One or more support arms 106 may be coupled to the top frame to support the top frame in the substantially horizontal position when the UAV payload receiving apparatus 100 is secured to the structure 116. In one implementation, the UAV payload receiving apparatus 100 includes two support arms 106. The first support arm 106 is coupled to the first short side of the top frame 102 and extends at a first angle toward the structure 116. The second support arm 106 is coupled to the second short side of the top frame 102 and extends at a second angle toward the structure 116. The support arms 106 may be adjustable in length and/or the angle between the support arms and the top frame may be adjusted so that the support arms 106 contact the structure 116 and support the top frame 102 in a substantially horizontal position. In the illustrated example, the two support arms 106 extend downward from the top frame 102 at approximately at forty-five degree angle and contact the vertical wall 120 of the structure 116.

The UAV payload receiving apparatus 100 also includes a payload retainer 104 that is coupled to the top frame, extends downward from the top frame, and is configured to receive and retain a payload released by a UAV into the UAV payload receiving apparatus 100. The payload retainer may be removably coupled to the top frame 102. For example, a top portion of the payload retainer 104 may include one or more buttons, adhesive, hooks, rivets, snaps, elastic, hook-and-loop fasteners, springs, clamps, slide fastener, etc. that may be used to secure the payload retainer 104 to the top frame. Because the UAV payload receiving apparatus 100 is positioned outdoors, it may be desirable to periodically remove the payload retainer for cleaning. In some implementations, the payload retainer 104 may be formed of a machine washable material so that the payload retainer 104 can be removed from the top frame 102 and machine washed.

The payload retainer 104 may be made of any flexible material. For example, the payload retainer may be formed from an ultraviolet (UV) resistant fabric formed in a mesh or net pattern. The spacing of the mesh or net pattern may be sufficient to allow water and small debris to pass through the payload retainer 104, but small enough to retain a payload placed into the UAV payload receiving apparatus 100.

The payload retainer 104 may have any elongated shape and extends in a downward direction from the top frame to receive a payload that passes through the opening of the top frame. In some implementations, the payload retainer 104 may have a first side, a second side, a third side, a fourth side and a bottom, all of which may be formed from the same or different flexible material.

Figure 3:
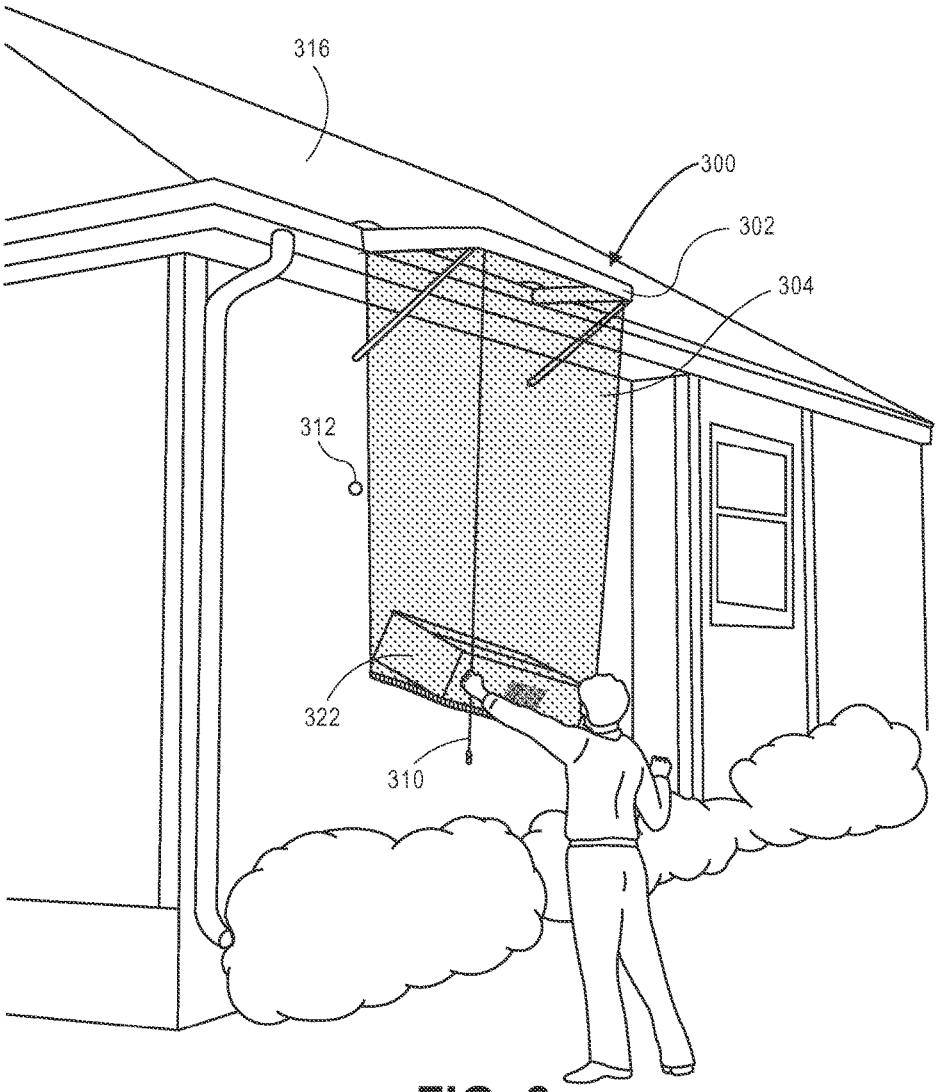
FIG. 3 is a view of an unmanned aerial vehicle payload receiving apparatus secured to a structure, in an extended position, and retaining a payload released by an unmanned aerial vehicle, according to an implementation.

The UAV payload receiving apparatus 100 may also include a retention cable that is configured to move the payload retainer 104 between a contracted position, as illustrated in FIG. 1, and an extended position, as illustrated in FIG. 3 (discussed below). When the payload retainer 104 is in a contracted position, the volume of the inner portion of the payload retainer 104 is reduced because a portion of the flexible material 108 is contracted up toward the top frame. By contracting the payload retainer 104, the payload retainer 104 is positioned out of the way of occupants, such as humans, of the structure 116, is less obtrusive, and provides security for any payload that is placed into the UAV payload receiving apparatus 100 because the payload is out of reach of humans and other animals.

The retention cable is coupled to an adjustment member 110 that is used to extend and/or contract the retention cable and move the payload retainer 104 between the extended position and the contracted position. The adjustment member 110 may be any form of manual, mechanical, or electrical mechanism for adjusting the retention cable. For example, the adjustment member 110 may be any one of a manual cable extending from the retention cable that may be manually manipulated to adjust the retention cable, a motor, such as a servo motor, that may be controlled to adjust the retention cable, a hand crank, a shepherds hook, a pulley that may be manipulated to adjust the retention cable, spring actuated and configured to move between the contracted position and the extended position when a payload is placed in the payload retainer, etc.

In some implementations, the adjustment member 110 may be secured with one or more security components 112. The security component 112 is configured to hinder or prohibit adjustment of the retention cable and movement of the payload retailer from the contracted position to the extended position. For example, the security component 112 may include a lock that must be opened with a key, code, biometrics or other identifier before the adjustment member 110 can be utilized. In other implementations, the security component 112 may simply be a hook, latch, or other retainer that is used to retain the adjustment member 110 when the adjustment cable is not in use.

In other implementations, the adjustment member 110 may include a spring with one end coupled to the top frame 102 and an opposing end coupled to a base of the payload retainer 104. In such a configuration, the adjustment member 110 may hold the payload retainer 104 in a contracted position. When a user desires to retrieve an item from the payload retainer 104, the user may pull down on the payload retainer 104 (e.g., using a handle affixed to the base of the payload retainer 104) to extend the payload retainer 104. When the payload retainer 104 is in the extended position, the handle or the base of the payload retainer 104 may be secured to a fixed location (e.g., hook, latch, etc.) so that the payload retainer remains in the extended position. When the payload retainer 104 is secured in the extended position, the user can retrieve a payload from the payload retainer 104. To return the payload retainer 104 to the contracted position, the base of the payload retainer 104 may be released from the fixed location and the adjustment member 110 causes the payload retainer to return to the contracted position.

Figure 2:
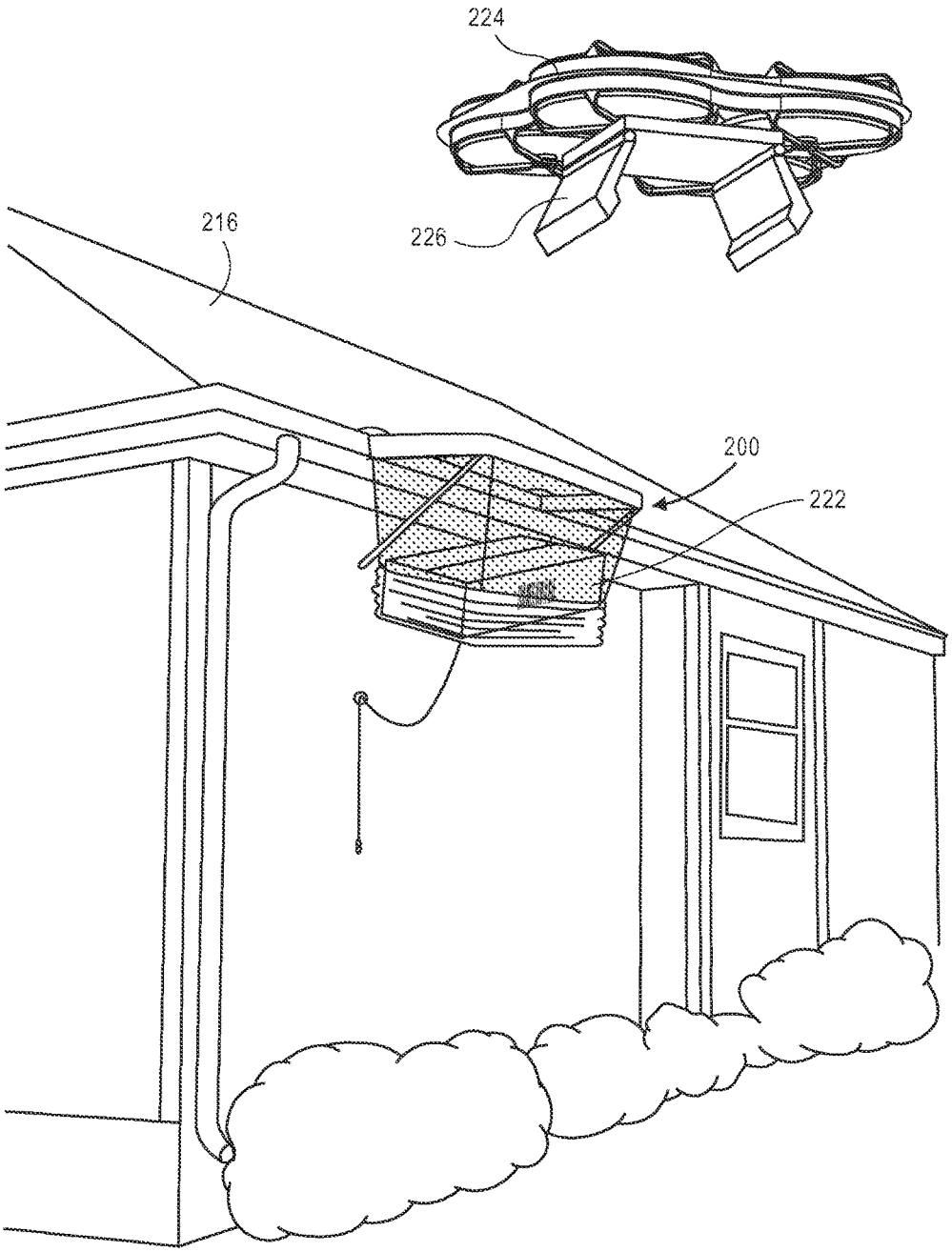
FIG. 2 is a view of an unmanned aerial vehicle payload receiving apparatus secured to a structure, in a contracted position and retaining a payload released by an unmanned aerial vehicle, according to an implementation.

FIG. 2 is a view of a UAV payload receiving apparatus 200 secured to a structure 216, in a contracted position, and retaining a payload 222 released by a UAV 224, according to an implementation. In this example, a user that resides in the structure 216 has ordered an item from an electronic commerce website and selected the structure 216 as the delivery destination for the item. As part of a delivery of the item to the user specified delivery location, the item is added as a payload to a UAV and the UAV 224 aerially navigates to the location of the structure 216. To complete delivery of the item to the user, the UAV 224 aerially navigates to a position above the UAV payload receiving apparatus 200 and releases the payload 222 from the payload engagement mechanism 226 of the UAV 224 so that the payload 222 descends through the opening formed by the top frame of the UAV payload receiving apparatus 200 and into the payload retainer, as illustrated in FIG. 2. The UAV 224 may then aerially navigate away from the location.

Because of the positioning of the UAV payload receiving apparatus 200 on an upper portion of the structure 216, such as the edge of the roof, the UAV may descend in the airspace above the structure, which is typically devoid of objects such as trees, humans, wires, etc. As the UAV 224 descends over the structure 216 it may identify the UAV payload receiving apparatus 200 and aerially navigate to a position above the UAV payload receiving apparatus 200. For example, the UAV payload receiving apparatus 200 may include one or more visual identifiers that are detectable by the UAV 224 to aid the UAV in detecting and positioning over the UAV payload receiving apparatus 200. Once the UAV 224 is positioned over the UAV payload receiving apparatus 200 and properly oriented so the payload will pass through the opening of the UAV payload receiving apparatus 200, the UAV may release the payload 222 and complete delivery of the payload to the destination.

By enabling the UAV to complete delivery of the payload at a higher altitude, the area around the delivery location is safer and the likelihood of the UAV contacting and/or damaging an object in or around the area is reduced. Likewise, as shown in FIG. 2, when the UAV payload receiving apparatus 200 is in a contracted position, the delivered payload is inaccessible or not easily accessible to humans or other ground based animals. Retaining the payload in the UAV payload receiving apparatus 200 when the UAV payload receiving apparatus 200 is in a contracted position therefore increases the security of the payload and the privacy of the user that requested delivery of the payload.

When a user desires to retrieve the payload from the UAV payload receiving apparatus 200, the user may move the payload retainer of the UAV payload receiving apparatus 200 from the contracted position (FIG. 2) to the extended position (FIG. 3) using the adjustment member.

FIG. 3 is a view of a UAV payload receiving apparatus 300 secured to a structure 316, in an extended position, and retaining a payload 322 released by a UAV, according to an implementation. As illustrated, the adjustment member 310 has been removed from the security component 312 and used to move the payload retainer 304 from the contracted position to the illustrated extended position. By extending the payload retainer 304, the retained payload is lowered downward toward a surface (e.g., ground) so that it can be removed from the UAV payload receiving apparatus 300. In some implementations, the payload retainer 304 may be different lengths depending on the distance between the top frame 302 of the UAV payload receiving apparatus 300 and the surface (e.g., ground). When the payload retainer 304 is in the extended position, any payload retained by the payload retainer 304 may be accessed through an access point in the payload retainer 304 and removed.

Figure 4:
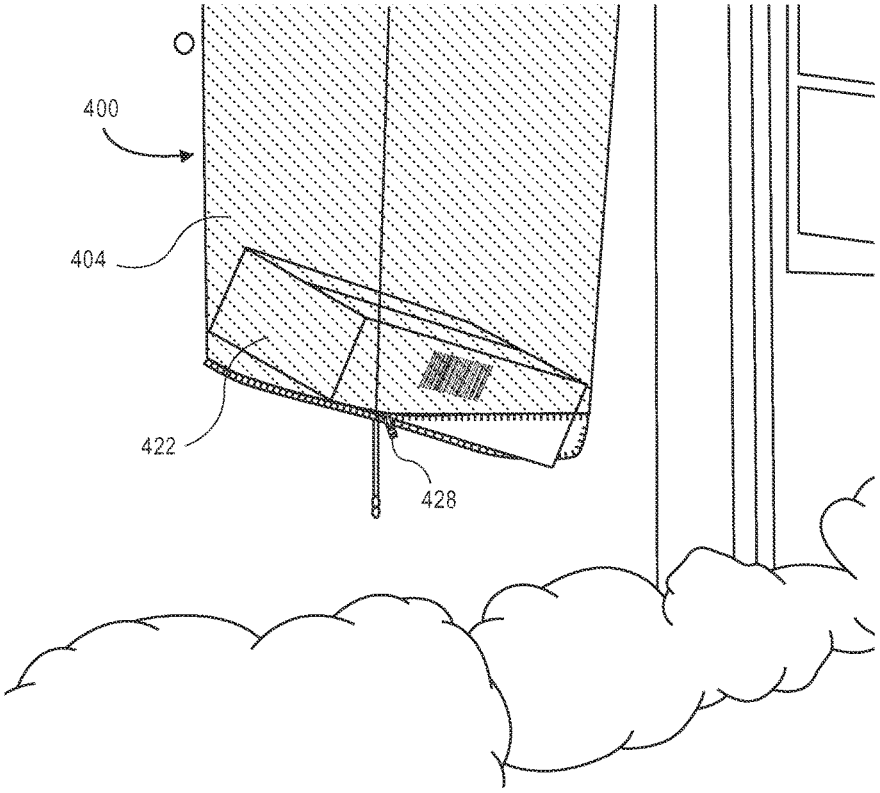
FIG. 4 is a view of a payload retainer of an unmanned aerial vehicle payload receiving apparatus secured to a structure, according to an implementation.

FIG. 4 is a view of a payload retainer 404 of a UAV payload receiving apparatus 400, according to an implementation. In this example, the payload retainer 404 includes an access point 428 in the form of a slide fastener. In this example, the slide fastener removably couples one or more sides of the payload retainer 404 with a bottom of the payload retainer 404. By opening the slide fastener, a user can access an inner portion of the payload retainer 404 and remove a payload 422 retained by the payload retainer 404.

The access point may be any form access point that can provide access to an inner portion of the payload retainer 404 so that a payload can be removed from the payload retainer 404. For example, the access point 428 may include buttons, an elastic opening, a hook-and-loop fastener, a slide fastener, snaps, etc. Likewise, while the example illustrated in FIG. 4 shows the access point coupling a side of the payload retainer to a bottom of the payload retainer, in other implementations the access point may be at other locations on the payload retainer such that it is accessible by a user on the surface when the payload retainer is in the extended position.

For example, in some implementations, the access point 428 may be an opening in the payload retainer 404 that is positioned part way up the payload retainer 428, such as at a position from the bottom of the payload retainer 404 that is approximately one-third of the total length of the payload retainer. In such a configuration, when the payload retainer 404 is in the contracted position, the opening is not accessible. However, when the payload retainer 404 is in the extended position, any payload retained in the payload retainer 404 will be below the opening and the opening will be accessible by a user to enable removal of the payload from the payload retainer 404.

In still another example, the payload retainer 104 may be formed as a cylindrical or other shaped coil such that the inner portion of the coil forms a cavity into which the payload may be placed. When the payload retainer is in a contracted position, the coils of the payload retainer 104 are positioned together such that the payload retainer 104 forms a cavity to retain the payload. When the payload retainer 104 is moved to an extended position, the coils of the payload retainer 104 separate, thereby allowing access to and removal of a retained payload from within the payload retainer 104. Specifically, a user may reach between two separated coils of the payload retainer 104 and retrieve a retained payload.

Figure 5:
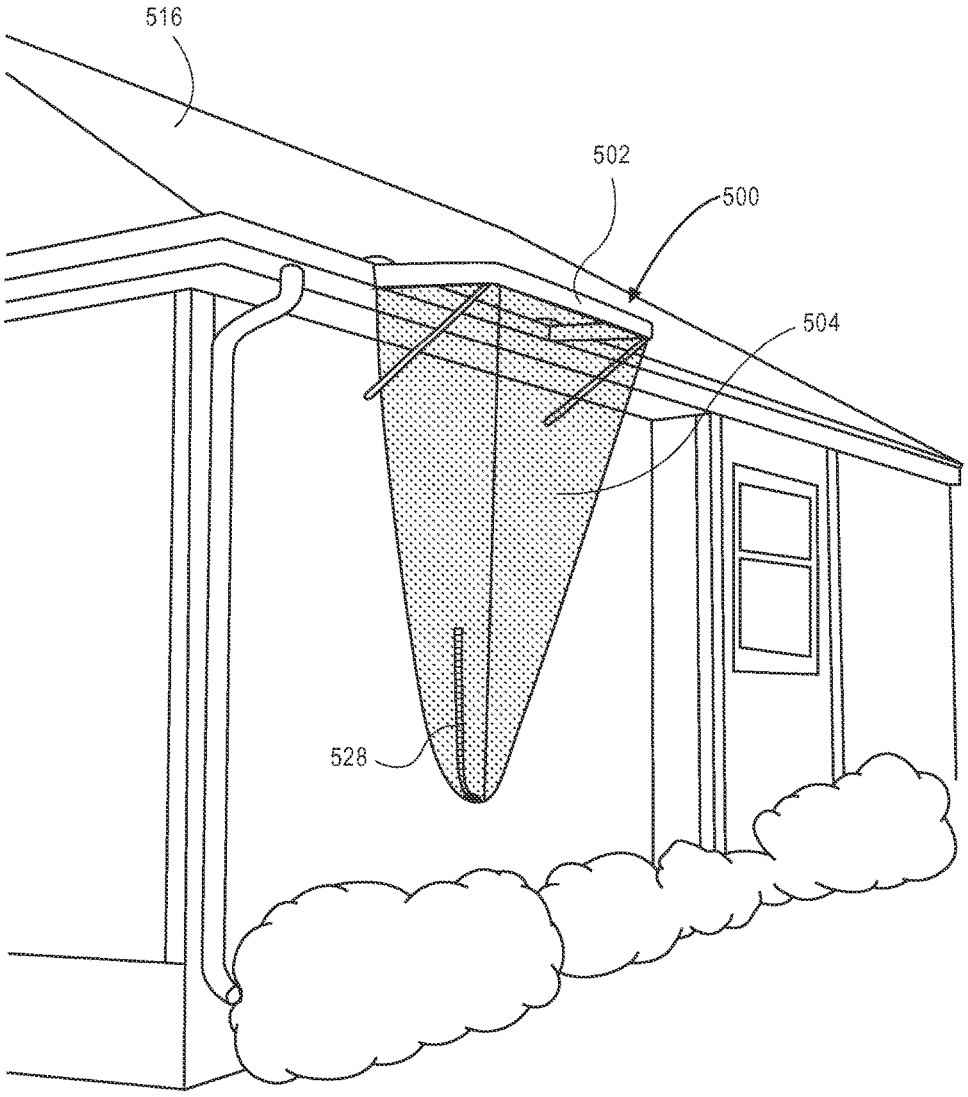
FIG. 5 is a view of another unmanned aerial vehicle payload receiving apparatus secured to a structure, and in an extended position, according to an implementation.

FIG. 5 is a view of another a UAV payload receiving apparatus 500 secured to a structure 516, and in an extended position, according to an implementation. In this example, the access point 528 is along a lower side of the payload retainer 504. Likewise, the payload retainer has an elongated tapered shape. In such an implementation, the payload retainer 504 may not be movable between an extended position and a contracted position. Instead, the payload retainer may remain in an extended position. When a payload is released into the UAV payload receiving apparatus 500 and passes through the opening of the top frame 502, the payload will contact the inner sides of the tapered payload retainer 504. The flexible material of the payload retainer and the tapered shape will slow the descent of the payload and safely retain the payload until it is retrieved by a user.

Figure 6:
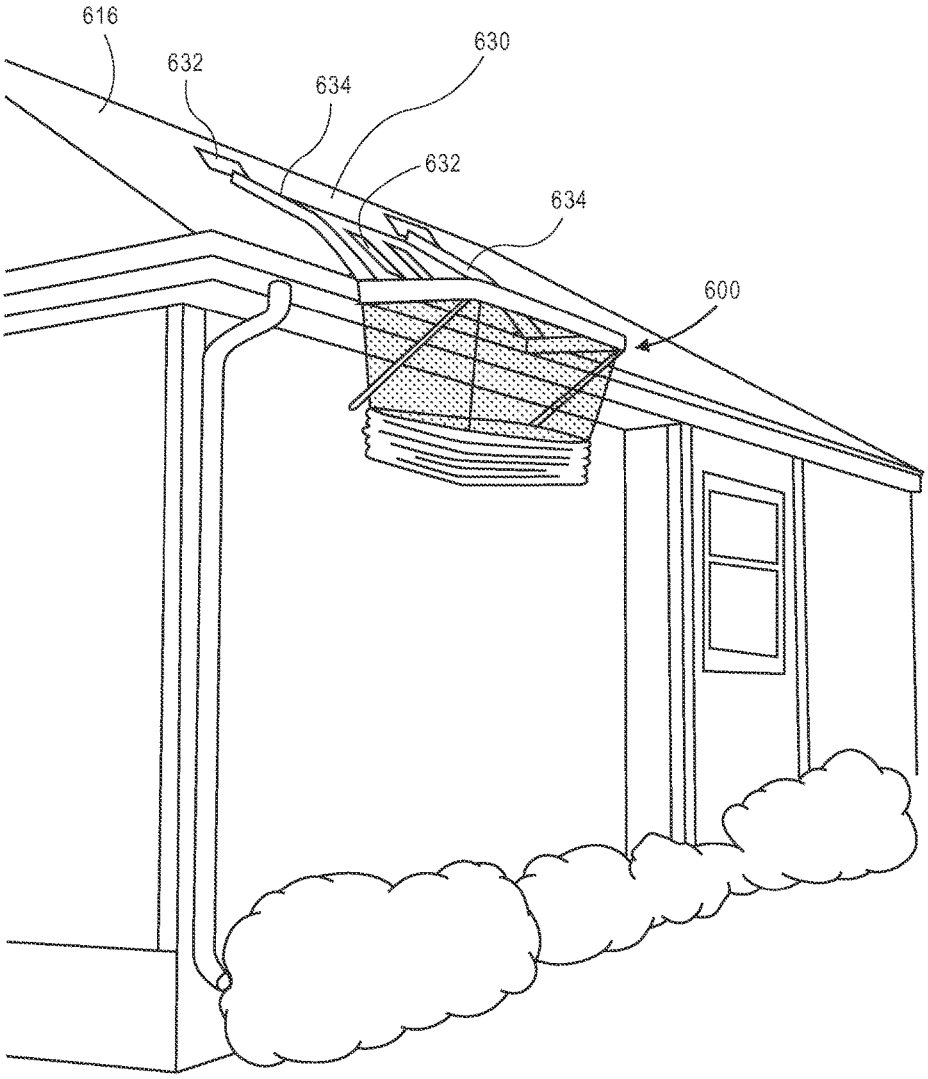
FIG. 6 is a view of an unmanned aerial vehicle payload receiving apparatus that includes a payload delivery guide, according to an implementation.

FIG. 6 is a view of a UAV payload receiving apparatus 600 that includes a payload delivery guide 630 positioned on the structure 616 to which the UAV payload receiving apparatus 600 is secured, according to an implementation. As illustrated, the payload delivery guide is positioned on a top of the structure, in this example on a roof of the structure 616, and adjacent to the top frame of the UAV payload receiving apparatus 600.

The payload delivery guide is used to guide a released payload into the UAV payload receiving apparatus 600. In such an implementation, rather than the UAV having to position the payload directly over the UAV payload receiving apparatus 600 and release the payload directly into the UAV payload receiving apparatus 600, the UAV can position the payload over the payload delivery guide 630 and release the payload onto the payload delivery guide 630. Because of the slope of the payload delivery guide and the vertical guides 634, the payload, under the force of gravity, will slide along the payload delivery guide 630 and into the UAV payload receiving apparatus 600.

The payload delivery guide 630 includes at least two vertical guides 634 that extend from the top frame of the UAV payload receiving apparatus 600 and along the top of the structure 614. In some implementations, the vertical guides 634 may extend in an outward angle from the top frame so the surface area of the payload delivery guide is lager and the vertical guides 634 act as funnels directing payloads into the opening of the top frame of the UAV payload receiving apparatus 600. The payload delivery guide 630 may also include a flat surface between the vertical guides 634 that has a low coefficient of friction so that the payload will slide over the flat surface and into the UAV payload receiving apparatus 600 under the force of gravity. For example, the flat surface may be aluminum, stainless steel, plastic, etc.

The payload delivery guide may also include one or more visual markers 632 that are detectable by the UAV to aid the UAV in identification of the payload delivery guide and/or alignment of the payload. For example, the visual markers 632 may be reflective markers, characters, colors, etc. that are detectable from an altitude to aid in the identifier of the payload delivery guide by a UAV.

While the examples discussed herein illustrate a payload receiving apparatus coupled, mounted, or otherwise secured to a structure, in some implementations the payload receiving apparatus may be a stand-alone unit. In such a configuration, the payload receiving apparatus may include a stand, legs, and/or other support members that are coupled to the top frame and aid in supporting the top frame in a substantially horizontal position so that a payload can be delivered into the payload receiving apparatus by a UAV. In such a configuration, the payload retainer may not move between contracted and extended positions, as the user may be able to retrieve the payload by reaching through the top frame and removing the payload. In other implementations, the payload retainer may still include one or more access points and/or may move between contracted and extended positions.

Although the disclosure has been described herein using exemplary techniques, components, and/or processes for implementing the apparatus of the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure. The dimensions, types, or sizes of the cross-sectional areas or shapes of the UAV payload receiving apparatuses disclosed herein are not limited. Furthermore, while some of the labels assigned to sides or bottoms of the UAV payload receiving apparatuses described herein may represent lengths or positions (e.g., "long" or "short"), other labels may be purely arbitrary (e.g., "side" or "end").

It should be understood that, unless otherwise explicitly or implicitly indicated herein, any of the features, characteristics, alternatives or modifications described regarding a particular implementation herein may also be applied, used, or incorporated with any other implementation described herein, and that the drawings and detailed description of the present disclosure are intended to cover all modifications, equivalents and alternatives to the various implementations as defined by the appended claims. Further, the drawings herein are not drawn to scale.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain implementations require at least one of X, at least one of Y, or at least one of Z to each be present.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative implementations thereof, the foregoing and various other additions and omissions may be made therein and thereto without departing from the spirit and scope of the present disclosure.

What is claimed is:

1. An unmanned aerial vehicle ("UAV") payload receiving apparatus, comprising:

a plurality of securing members to removably secure the UAV payload receiving apparatus to a structure;

a top frame including a first long side, a second long side, a first short side, and a second short side, wherein:

the top frame is coupled to the plurality of securing members and is laterally offset from the structure when the UAV payload receiving apparatus is secured to the structure; and the first long side, the second long side, the first short side, and the second short side form a perimeter having a size that allows a payload released by a UAV to pass through;

a first support arm coupled to the top frame and extending at a first angle toward the structure, wherein the first support arm supports at least a portion of the top frame in the laterally offset position when the UAV payload receiving apparatus is secured to the structure;

a second support arm coupled to the top frame and extending at a second angle toward the structure, wherein the second support arm supports at least a portion of the top frame in the laterally offset position when the UAV payload receiving apparatus is secured to the structure; and a payload retainer defined by a first side, a second side, a third side, a fourth side, and a bottom, wherein:

the payload retainer has an elongated shape, is coupled to the top frame and extends in a downward direction from the top frame to receive the payload that passes through the perimeter of the top frame;

each of the first side, the second side, the third side, the fourth side, and the bottom is formed from a flexible material; and the bottom forms a portion of the payload retainer distinct from each of the first side, the second side, the third side, and the fourth side; and a retention cable configured to move the bottom of the payload retainer in a vertical direction toward or away from the top frame between a contracted position and an extended position.

2. The UAV payload receiving apparatus of claim 1, wherein in the contracted position, the retention cable is configured to contract one or more of the first side, the second side, the third side, and the fourth side toward the top frame.

3. The UAV payload receiving apparatus of claim 1, wherein in the extended position, the retention cable is configured to extend one or more of the first side, the second side, the third side, and the fourth side such that the bottom is within a reach of a user standing on a surface.

4. The UAV payload receiving apparatus of claim 1, further comprising:

a slide fastener connecting the first side and the bottom, wherein:

the payload is retained in the payload retainer when the slide fastener is in a closed position; and the payload is removable through an opening formed between the first side and the bottom when the slide fastener is in an open position.

5. The UAV payload receiving apparatus of claim 1, wherein the payload retainer is configured to receive the payload that is delivered and released by the UAV, the payload including an item ordered by a user of an electronic commerce website for delivery to a residence.

6. An unmanned aerial vehicle ("UAV") payload receiving apparatus, comprising:

a plurality of securing members to removably secure the UAV payload receiving apparatus to a structure;

a top frame coupled to the plurality of securing members, wherein:

the top frame extends from the structure when the UAV payload receiving apparatus is secured to the structure; and the top frame forms an opening having a size that allows a payload released by a UAV to pass through; and a payload retainer coupled to the top frame that extends in a downward direction from the top frame to receive the payload that passes through the opening of the top frame; and a retention cable configured to move a bottom of the payload retainer in a direction toward or away from the top frame between a contracted position and an extended position wherein the bottom forms a portion of the payload retainer distinct from sides of the payload retainer.

7. The UAV payload receiving apparatus of claim 6, further comprising:

a first support arm coupled to the top frame and extending at a first angle toward the structure, wherein the first support arm supports at least a portion of the top frame when the UAV payload receiving apparatus is secured to the structure; and a second support arm coupled to the top frame and extending at a second angle toward the structure, wherein the second support arm supports at least a portion of the top frame when the UAV payload receiving apparatus is secured to the structure.

8. The UAV payload receiving apparatus of claim 7, wherein the first support arm and the second support arm are each adjustable in length.

9. The UAV payload receiving apparatus of claim 6, wherein the payload retainer is formed from a flexible material in a mesh pattern.

10. The UAV payload receiving apparatus of claim 6, further comprising:

an adjustment member coupled to the retention cable to extend or contract the retention cable;

wherein the retention cable is configured to move the payload retainer between the contracted position in which a volume of an inner portion of the payload retainer is reduced and the extended position in which a volume of the inner portion of the payload retainer is increased.

11. The UAV payload receiving apparatus of claim 10, wherein the adjustment member is at least one of a manual cable extending from the retention cable that is manually manipulated to adjust the retention cable, a hand crank, a shepherds hook, a motor that is controlled to adjust the retention cable, a pulley that is manipulated to adjust the retention cable, or spring actuated and configured to move between the contracted position and the extended position when a payload is placed in the payload retainer.

12. The UAV payload receiving apparatus of claim 10, wherein the adjustment member includes a security component to resist unauthorized adjustment of the retention cable.

13. The UAV payload receiving apparatus of claim 10, wherein the retention cable is configured to move the bottom of the payload retainer closer to the top frame when the payload retainer is in the contracted position.

14. The UAV payload receiving apparatus of claim 10, wherein the retention cable is configured to move the bottom of the payload retainer farther from the top frame when the payload retainer is in the extended position.

15. The UAV payload receiving apparatus of claim 10, wherein the payload retainer includes at least one of a button, an adhesive, a rivet, a snap, an elastic, a hook-and-loop fastener, a spring, a clamp, or a slide fastener to removably attach the payload retainer to the top frame.

16. The UAV payload receiving apparatus of claim 6, further comprising:

a visual marker positioned on the top frame.

17. An unmanned aerial vehicle ("UAV") payload receiving apparatus, comprising:

a plurality of securing members to removably secure the UAV payload receiving apparatus to a structure;

a top frame coupled to the plurality of securing members, wherein:

the top frame extends from the structure when the UAV payload receiving apparatus is secured to the structure; and the top frame forms an opening having a size that allows a payload released by a UAV to pass through; and a payload retainer having an open end that is coupled to the top frame and positioned to receive the payload, and an opposing end configured to retain the payload in the payload retainer, wherein the opposing end forms a portion of the payload retainer distinct from sides of the payload retainer; and a retention cable configured to move the opposing end of the payload retainer in a direction toward or away from the top frame between a contracted position and an extended position.

18. The UAV payload receiving apparatus of claim 17, further comprising:

an access point at a location along the payload retainer to provide access to an inner volume of the payload retainer.

19. The UAV payload receiving apparatus of claim 18, wherein the access point includes at least one of an opening, a button, a hook-and-loop, an elastic, a placket, a slide fastener, or a snap.

20. The UAV payload receiving apparatus of claim 6, further comprising:

a cover moveably coupled to the top frame, the cover configured to cover the opening of the top frame in a default state and configured to uncover the opening to receive the payload that passes through the opening of the top frame.

* * * * *